United States Patent [19]

Smith

[11] Patent Number: 4,526,007

[45] Date of Patent: Jul. 2, 1985

[54] ELECTROMAGNETIC TURBINE SYSTEM

[76] Inventor: Raymond H. Smith, Rte. 2 - 5AAA, Larned, Kans. 67550

[21] Appl. No.: 495,959

[22] Filed: May 19, 1983

[51] Int. Cl.[3] ..... F01B 21/04

[52] U.S. Cl. ..... 60/698; 60/721; 310/46

[58] Field of Search ..... 60/325, 650, 682, 698, 60/716, 721; 310/46

[56] References Cited

U.S. PATENT DOCUMENTS 2,127,166 8/1938 Findley ..... 310/46 X 3,992,132 11/1976 Putt ..... 310/46 X

*Primary Examiner*—Stephen F. Husar

*Attorney, Agent, or Firm*—Litman, Day and McMahon

[57] ABSTRACT

A multifunctional magnetic systems, draft, centrifugal force turbine which employs magnetic attraction and repulsion systems including a turbine with turbine magnets and magnetic shield magnets. The magnetic attraction and repulsion systems are augmented by a cooling system which creates a draft through the motor. The magnetic systems simultaneously with a compression-partial vacuum motor which is integrally connected with draft and atmosphere pressure upon turbine curved blades. A compression-partial vacuum motor has a centrally located within a compression-partial vacuum piston within its rectangular and arched character. That placement of the compression-partial vacuum piston completes the formation of two shrinkable-expandible compartments—one at each end of the compression-partial vacuum piston. Within these compartments are contained atmosphere which is intermittently compressed and forced through jets to impinge upon turbine curved blades. Intermittently the compression-partial vacuum piston contracts and allow for return of atmosphere through a return orifice resulting in localized partial vacuums. The plurality of compression-partial vacuum motor is integrally connected to a conveyance tube between an exterior casing and the exterior of the compression-partial vacuum motor. Moreover, several centrifugal force systems contribute to the functioning of the present invention, included in this is expansible-contractive cylindrical divider which also is important in holding atmospheric pressure on the turbine curved blades longer.

19 Claims, 3 Drawing Figures

ELECTROMAGNETIC TURBINE SYSTEM

BACKGROUND OF THE INVENTION

1. Field of the Invention

The present invention relates generally to motors and in particular to a motor utilizing a magnetic attraction and repulsion, centrifugal draft, and compression and partial vaccum for improved performance.

A compression-partial vacuum motor comprising of a compression-partial vacuum piston disposed within the central portion of the compression-partial vacuum motor in a manner to form two opposite compartments. A pair of magnets disposed within the compression-partial vacuum piston, each connect to diametrically opposite slidable sections of the component, and having confronting poles of like polarity. The confronting magnets are electromagnets. Thus, they repel one another when electric current is supplied to the electromagnets, in order to extend the compression-partial vacuum piston to compress atmosphere in the compartments. One of each of a set of electromagnets is permanently activated. The second electromagnet of the set is intermittently energized. By automatically discontinuing the electric current, the atmosphere in the opposite compartments of the compression-partial vacuum motor compresses the compression-partial vacuum piston; thus, resulting in a localized partial vacuum in a turbine duct.

2. History of Prior Art

Motors utilizing magnetic repulsion and attraction systems are well known and a variety of such motors have been developed in an attempt to maximize output and operating efficiency. Also, the use of wind currents and drafts for imparting a rotary motion is well known in wind mills, wind turbines and the like. Similarly, devices for compressing atmosphere are known which are very efficient.

A prior invention related hereto has been applied for by the present inventor. The previous apparatus is entitled Magnetic-Hydraulic Pump, Ser. No. 06/466,667 and with a filing date of Feb. 15, 1983, now abandoned.

Heretofore there has not been available a motor which utilizes the principles of magnetic repulsion and attraction and compression and localized partial vacuum augmented by a draft caused by a cooling system in conjunction with heat, which is employed to advantage before being discharged, from a plurality of electromagnetic coils. Reference must be made to the present inventor's Magnetic Centrifugal Draft Motor, U.S. patent application Ser. No. 448,624, filed Dec. 10, 1982.

The present invention is the result of fourteen years of thought and development on progressive apparatus, experimenting, and study in relation to magnetic motors, and two years working with an efficient atmospheric compression motor. A magnetic motor and an atmospheric compression motor, with substantial variations, improvements, omissions, and additions. Some additional components include turbine curved blades, expansible-contractive cylindrical divider, bowed attachment (a component to lessen friction as the apparatus functions), and a conveyance tube (of the atmospheric compression motor). They are combined into one apparatus employing a single arrangement of magnets. The present invention functions in different ways from the inventor's previous inventions, including rearrangement of electromagnets, expansion and compression functioning of a plurality of atmospheric compression motors, and a guidance arrangement for each atmospheric compression motor. Thus, the present invention is much more energy efficient than the two operating separately. Moreover, the present invention, which enhance other systems, including draft, cooling, three centrifugal force systems, and compressing systems, to perform cooperatively for central purposes. Moreover, generally the inputs have more than one purpose, and generally each component has more than one function in the proper functioning of the present invention.

There is no known arrangement of components that have the particular arrangement of components nor the combined purposes, objects, and purposes conceivable from provoked cognition by this invention and Patent Application.

The development of efficient motors is particularly important due to the finite limitations on the world's supply of fossil fuels.

SUMMARY OF THE INVENTION

In the practice of the present invention, a motor is provided with push and pull electromagnetic systems and compression and localized partial vacuum systems. The operation of the magnetic systems is augmented by a draft which is created within the motor by a refrigeration system and heat by-products from a plurality of electromagnetic coils and jets of compressed atmosphere. A cooling unit functions to enhance a draft through a turbine duct. Magnetic shields are utilized in conjunction with the magnets to further enhance their operation. Compressed atmosphere intermittently function with localized partial vacuum integrally cooperating with the other systems and physical factors and mechanical principals.

In addition, there is a commonly employed device on internal combustion engines, a coil, to enhance an electric current which is similarly employed in this invention.

Centered within a compression-partial vacuum motor (atmospheric compression motor) is a compression-partial vacuum piston containing a set of multipurpose electromagnets to create compression and partial vacuums. Within created end compartments is atmosphere. The compression-partial vacuum piston is connected intermittently with a turbine duct by an inlet and by an atmospheric jet directed into the turbine duct.

It, also, comprises the compression-partial vacuum chamber and magnetic valves. The magnetic compression-partial vacuum piston has multipurpose electromagnets with confronting poles of like polarity, whereby the well-known repelling effect between like magnetic poles intermittently urges the poles apart to furnish a compressing force on atmosphere. With the discontinuation of electricity to an intermittent multipurpose electromagnet, compression springs and returning atmosphere help urges the contraction of the compression-partial vacuum piston.

One of the differences between the present inventor's invention and his previous invention, magnetic centrifugal draft motor, is the arrangement of electromagnets. In the former invention a push and pull stationary electromagnet were situated to influence a plurality of turbine magnets with opposing polarity in relation to one another. In the present invention, multipurpose electromagnets, with the same polarity, attract and repel turbine magnets in unison while also performing a second function of compressing atmosphere and forcing it through a plurality of atmospheric jets to increment the flow of draft and directly influence a turbine. (When the electrical current is intermittently discontinued to one of a set of multipurpose electromagnets, atmosphere is pulled into compression chambers and results in localized partial vacuum in a turbine duct in a manner and positioning that results in incrementing the movement of the turbine.) Thus, the multipurpose electromagnets are increasing the movement of the turbine through a more efficient arrangement and additional purposes.

The principal objects of the present invention are: to provide a turbine which may be used in place of conventional electric motors, internal combustion engines, and steam engines; to provide such a motor which may be used for transporation, industry, emergency power devices and the like; to provide such a turbine in conjunction with other machinery to produce electricity; to provide such a turbine in conjunction with other equipment to produce heat as for homes and buildings; to provide such a turbine which is not reliant on fossil fuels including petroleum, coal, and the like; to provide such a turbine which is more versatile and less restrictive in utilization than conventional electric motors, internal combustion engines, steam engines, atomic reactors and the like because of fuel requirements; to provide such a turbine which contributes considerably less to air and water pollution than comparable internal combustion engines; to provide such a turbine which does not require extensive emissions controls; to provide such a turbine which is adaptable for a wide variety of applications with particular power, speed, and purpose requirements; and to provide such a turbine which is economical to manufacture, efficient in operation, capable of a long operating life and particularly well adapted for the proposed usage thereof.

(There are a number of ways to create more speed and power from the apparatus. Among these are: (1) improving placement and increase the number and strength of turbine magnets and multipurpose electromagnets, (2) increasing the strength of turbine magnets, (3) adding more rows of multipurpose electromagnets and turbine magnets, and (4) improving the efficiency of the electrical system.)

According to McGraw-Hill's *Encyclopedia of Energy,* 1976: Within the U.S. during the 1990s, gas and petroleum resources will begin disappearing as major components in the national energy system. Conversely, as noted in other sources, magnets are being improved frequently and have been particularly since the 1930s.

Moreover, as noted on page 69 of Hellman's *High Energy Physics:* "Since the photons are not lost to the particles involved, there is no energy loss which is why a magnet does not expand energy in holding up an iron bar, and why two charges can attract or repel each other forever."

An input of the present invention is permanent magnets, being man-made and energized power source. The plurality of permanent magnets interacting with multipurpose electromagnets also improves magnetic permeability. Second, an input is a refrigerant. A third input is electric current, which is regenerated by the invention and enhanced by the ignition coil. The electric current contributes to magnetic systems, contributes to a byproduct of heat from electromagnetic coils, contributes to initiate compressed atmosphere force through atmospheric jets to enhance draft and impingement on the turbine. Moreover, it is important to initiating localized partial vacuums while the flow of current is discontinued; furthermore, electric current intermittently activates a cooling unit. Magnetism is diminished by increased temperature; thus, there is better magnetic permeability between cooler magnets.

Other objects and advantages of this invention will become apparent from the following description taken in conjunction with the accompanying Drawings wherein are set forth by way of illustration and example, certain embodiments of this invention.

The Drawings constitute a part of this specification and include exemplary embodiments of the present invention and illustrate various objects and features thereof.

BRIEF DESCRIPTION OF THE DRAWINGS

Other and further features of the present invention will hereinafter more fully appear in connection with a detailed description of the drawings in which.

DETAILED DESCRIPTION OF THE PREFERRED EMBODIMENTS

Figure 1:
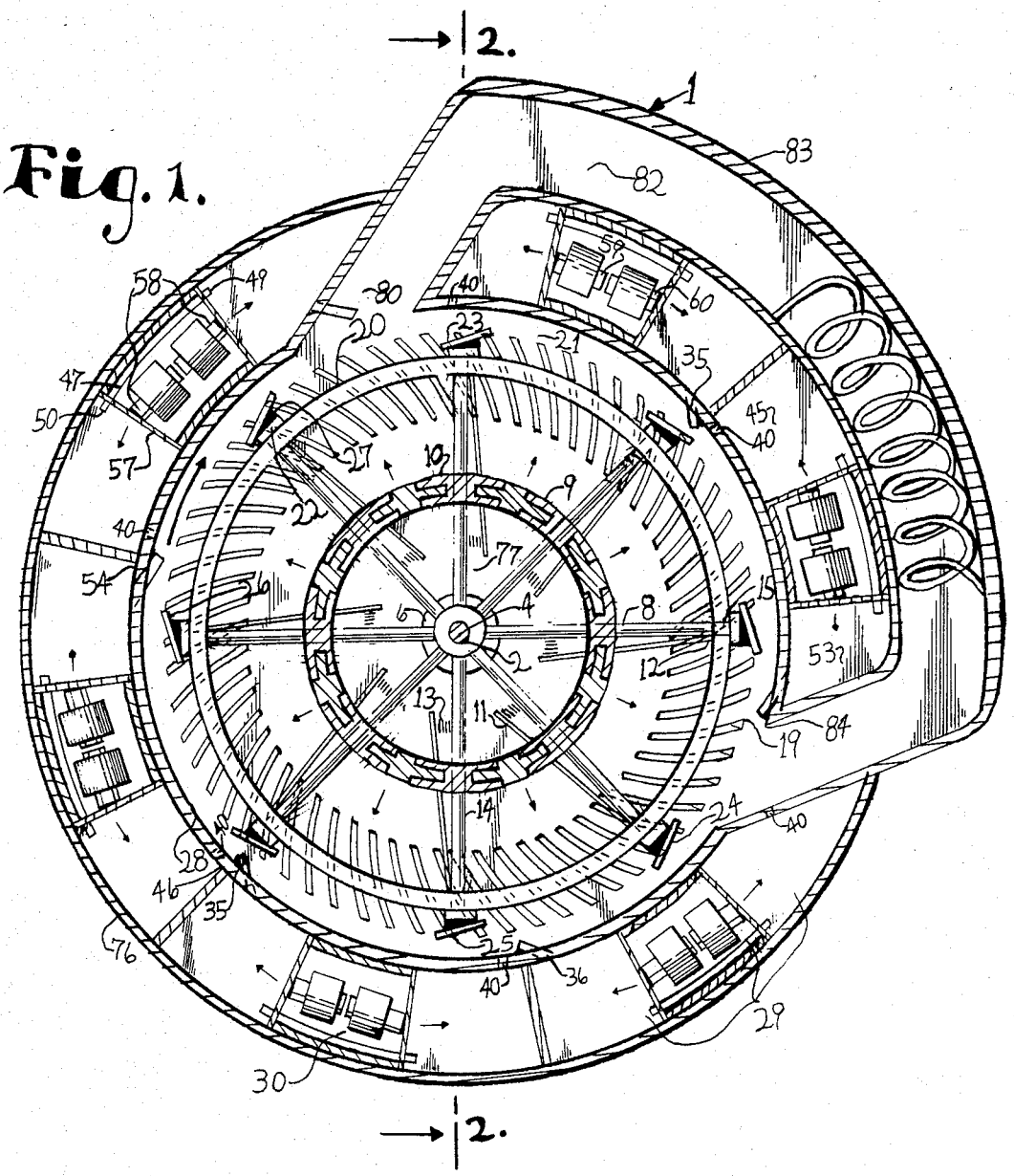
FIG. 1 is a cross-sectional view of a multifunctional magnetic systems, draft, centrifugal force turbine embodying the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the Drawings in more detail, like reference numerals are applied to similar parts throughout the several views. The numeral 1 generally designates a multifunctional magnetic systems, draft, centrifugal force turbine embodying the present invention. The reference numeral 76 designates an outer casing for the apparatus 1. The outer casing 76 allows for the advantageous housing of the various components thereof to produce the power and speed desired for a particular application of the apparatus 1. In particular, the outer casing 76 is designed to secure and be a part of a plurality of compression-partial vacuum motors 29.

Similarly, most of the inputs contribute to the functioning of the apparatus 1 in more than one way. For instance, a plurality of permanent turbine magnets 22 help create better permeability with coinciding multipurpose electromagnets 59 and 60 and contribute to total magnetic force influencing a turbine 20; the plurality of turbine magnets 22 contribute to centrifugal force while the apparatus 1 is energized.

Furthermore, an important aspect of this invention is that most of the components have more than one function. For example, multipurpose electromagnets 59 and 60 are a key component in attracting and repelling the turbine 20 and for compressing atmosphere to be released through atmospheric jets 35 disposed in a plurality of heat atmospheric chambers 53 to influence the turbine 20 and to contribute to draft. The atmospheric discharge jets 35 impart atmospheric force against a turbine curved blades 19 and a plurality of magnetic shields 23. Also, multipurpose electromagnets 59 and 60 contribute to centrifugal force systems, and influence the proper functioning of a plurality of return orifice permanent magnetic valves 42, and multipurpose electromagnets 59 and 60 are important to cause localized partial vacuum.

The operation of the multifunctional magnetic systems, draft, centrifugal force turbine 1 is effected by magnetic systems, a cooling system, a compression system, a localized partial vacuum system, a draft system, centrifugal force systems, a number of related physical properties, and mechanical factors, including overall design of the apparatus 1.

The outer casing 76 comprises a nonmagnetic material and includes components which are suitably joined in a detachable manner so as to allow access to components positioned in the interior of the outer casing.

A shaft 2 is centrally located within the apparatus 1 and includes a plurality of supports 8 which radiate outwardly from the shaft in spaced positions whereby a spoke-like configuration is formed as shown in FIG. 1. The supports 8 extend radially outwardly from the shaft 2 in equally spaced relation with respect to each other. The supports 8 terminate at respective far ends 15 equidistance from the shaft 2. There is a different number of supports 8 to the number of compression-partial vacuum motors 29 to prevent potential magnetic drag occuring at simultaneous intervals.

The far ends of the supports 15 have crosspieces 16 connected thereto and longitudinally aligned with the shaft 2. The shaft and the supports 8 comprise portions of the turbine 20. The shaft 2 extends through the center of the turbine 20 coaxially therewith.

A plurality of support connectors 18 extend in a transverse manner relative to the shaft 2 and in a circular manner with respect to the respective supports 8 which are positioned on ends 17 of respective crosspieces 16. The plurality of turbine curved blades 19 are appended from one support connector 18 to another support connector in a parallel manner to the shaft 2 and are effected favorably by the draft. The plurality of turbine curved blades 19 are shown in FIG. 1. The turbine 20 is aerodynamically designed in such a way as to minimize atmospheric resistance to rotation. The turbine 20 is mounted within a turbine duct 21 in an unrestrained manner.

The shaft 2 includes a central portion 3 with a lesser diameter than shaft end portions 4. Bearing units 5 receive the end portions of the shaft 4. The shaft 2 extends in an unrestrained manner through washers 6, bearings units 5 and beyond end outer casings 77 which are positioned perpendicularly to the shaft. The washers 6 are positioned between each bearing unit 5 and respective supports 8 about the shaft 2 to maintain appropriate spacing therebetween to allow for better movement of the shaft.

A shaft cog 7 is attached to an end portion of the shaft 2. The shaft cog 7 is adapted to mesh with an extrinsic component 85 which is to be driven by the multifunctional magnetic systems, draft, compression force turbine 1. As an alternative to the shaft cog 7, a direct drive connection between the shaft 2 and the extrinsic component 85 may be utilized. The extrinsic component 85 may comprise any of a variety of types of machinery and the like to be driven by the apparatus 1.

The supports 8 weight considerably less than the crosspieces 16, attachments thereto and support connectors 18 comprises a first centrifugal force system. This relative difference in weight facilitates the centrifugal force which enhances the operation of the apparatus 1 and provides a flywheel effect for smoother performance.

Another centrifugal force system which enhances the operation of the motor comprises a constant increment of systematic weight variation with respect to the aligned sets of adjacent supports and the crosspieces 16. It also functions to maintain momentum. There is a systematic weight increment in a progressive manner until the maximum weight components are adjacent to the lightest components.

An expansible-contractive cylindrical divider 9 consists of a movable membrane within a sheath 10. Thus, it allows expansion while the apparatus 1 is activated, and then contracts to its former position when the apparatus 1 stops. The expansible-contractive cylindrical divider 9 moves farther outwardly from the shaft 2 while the apparatus is in incessant motion and thus comprising a third centrifugal force system.

There is a component to lessen friction between expansible-contractive cylindrical divider 9 and the supports 8. Each support 8 has a bowed attachment 11 which is affixed and extend from an outermost end of the support 12 and to a bowed attachment spring 13 nearer the shaft 2 on forward side to the direction of the turbine's movement 14. With the deactivation of the apparatus 1, the bowed attachment spring 13 press inwardly toward the support 8.

Fixedly mounted on the crosspieces 16 are permanent turbine magnets 22 which are intermittently brought into proximity to multipurpose electromagnets 59 and 60 by rotation of the turbine 20. The turbine magnets 22 are bar magnets and are spaced and alternated in orientation on each of the crosspieces 16 in a systematic manner so that in relation to the movement of the turbine 20, the front pole of the turbine magnets 22 are of the opposite magnetic charge of respective multipurpose electromagnets 59 and 60. The poles of the turbine magnets 22 determine whether pulled or pushed at a given instance as a result of having the same polarity and opposite polarity as multipurpose electromagnets 59 and 60.

One of a set of multipurpose electromagnets 58 is intermittently energized 60 and the second multipurpose electromagnet 59 is constantly energized. They are supplied with a source of alternating current (not shown) as long as the apparatus 1 is activated. The apparatus 1 is provided with a commutator for intermittently changing the direction of current (also not shown).

Associated with each turbine magnet 22 is the respective magnetic shield 23 comprising a nonmagnetic material 27. A magnetic shield magnet 24 is mounted on each magnetic shield 23. One of the main purposes of the magnetic shield magnets 24 is to limit drag of the turbine magnets 22 in relation to the multipurpose electromagnets 59 and 60 with as little adverse effect as possible. The magnetic shield magnet 24 has an inner pole, which is opposite to the turbine magnet 22, that is to help reduce undesirable magnetism between the turbine magnet 22 and the multipurpose electromagnets 59 and 60. Thus, the magnetic shield magnets 24 must be relatively weak.

The magnetic shield magnets 24 are slanted, preferably at an angle of less than 45 degrees in relation to the turbine magnets 22. The poles of the magnetic shield magnets 24 are thus oriented so that they will be influenced by the poles of the multipurpose electromagnets 59 and 60 having the same polarity while preventing stronger permanent turbine magnets 22 from periodically reacting adversely with electromagnets 59 and 60. Moreover, the angular orientation of the magnetic shield magnets 24 functions to limit periodical interference of the turbine magnets 22 and the multipurpose electromagnets 59 and 60.

The magnetic shield magnets 24 are affixed to the nonmagnetic material 27 of the magnetic shield 23 in a systematic angle with respect to the turbine magnets 22 in the turbine paths thereof. The angulation of the magnetic shield magnets 24 is determined primarily by the strengths of the multipurpose electromagnets 59 and 60, the turbine magnets 22 and the respective distance between various magnets 22, 24, 59, and 60. Another factor in determining the appropriate angle of orientation for the magnetic shield magnets 24 relates to the diameter of the turbine 20. The magnetic shield 23 rotates with the turbine 20 in a position beyond the pheriphery of permanent turbine magnets 22.

The polarity of the magnetic shield magnets 24 is the same as that of the poles of the multipurpose electromagnets 59 and 60 which influence them. Thus, the permanent turbine magnets 22 are much less adversely affected by the multipurpose electromagnets 59 and 60 which are periodically in a position beyond the peripheral path of the turbine magnets 22.

Preferably, the magnetic shield magnets 24 are weaker than the multipurpose electromagnets 59 and 60 and weaker than the turbine magnets 22. The magnetic shield magnets 24 are substantially weaker than the permanent turbine magnets 22 in their respective magnetic interaction with the multipurpose electromagnets 59 and 60.

As shown in FIG. 1, the magnetic shield magnets 24 are angulated to allow the multipurpose electromagnets 59 and 60 to influence the turbine magnets 22 in a direction more toward the proper direction of rotation of the turbine 20. The angulation of the magnetic shield magnets 24 is preferable to affixing them parallel with the permanent turbine magnets 22 which would result in the multipurpose electromagnets 59 and 60 exerting forces directed radially toward the center of the turbine 20, thus, slowing the motion of the turbine with the multifunctional magnetic systems, draft, centrifugal force turbine 1 in operation.

As noted the multipurpose electromagnets 59 and 60 exert force upon the magnetic shield magnets 24 in a direction that is more complimentary to the rotary motion of the turbine 20 and thus help to propel it, also, it contributes to helping initial starting in cooperation with the multipurpose electromagnets 59 and 60 and draft systems. However, before the magnetic shield magnets 24 are in their respective beneficial positions as heretofore described, a certain amount of magnetic interference between the magnetic shield magnets 24 and the multipurpose electromagnets 59 and 60 occurs. This magnetic interference is considerably less than it would be if the magnetic shield magnets 24 were replaced by a diamagnetic material with all of the other variables such as relative placement and distance between the components being the same.

Outer poles 25 of the magnetic shield magnets 24 are not covered by any material. Similarly, inner poles 26 of the magnetic shield magnets 24 are spaced from the nonmagnetic material 27 that they are affixed to.

The strengths of the cooperating magnets 22, 24, 59, and 60 and the relative distances therebetween are important as a result of adversely affecting upon one another, especially reversing polarity of successively weak magnets which are incorrectly placed in a cooperative manner with very strong magnets. The proper placement of the magnetic shield magnets 24 and their respective distances from the permanent turbine magnets 22 are as shown in FIG. 1. However, they should be in spaced relation. Preferably, the magnetic shield magnets 24 are substantially weaker than either of the multipurpose electromagnets 59 and 60.

Within an interior of a compression-partial vacuum motor 44 are two mobile pins 71 and 74 which are portions of compression-partial vacuum piston. The pans 71 and 74 contour with the outer casing of the multifunctional magnetic systems, draft, centrifugal force turbine 1. Also, the mobile pans 71 and 74 consisting of a segment one 70 and a segment two 73 which constitutes a planar portion 57 of each segment and nonferrous side walls 31 and are the interior of a compression-partial vacuum piston 56. A piston 30, which includes mobile arched nonferrous pans 71 and 74 and multipurpose electromagnets 59 and 60, acts to compress atmosphere which is present at each end of the compression-partial vacuum piston 30 in atmospheric chambers 45 and 53.

Figure 2:
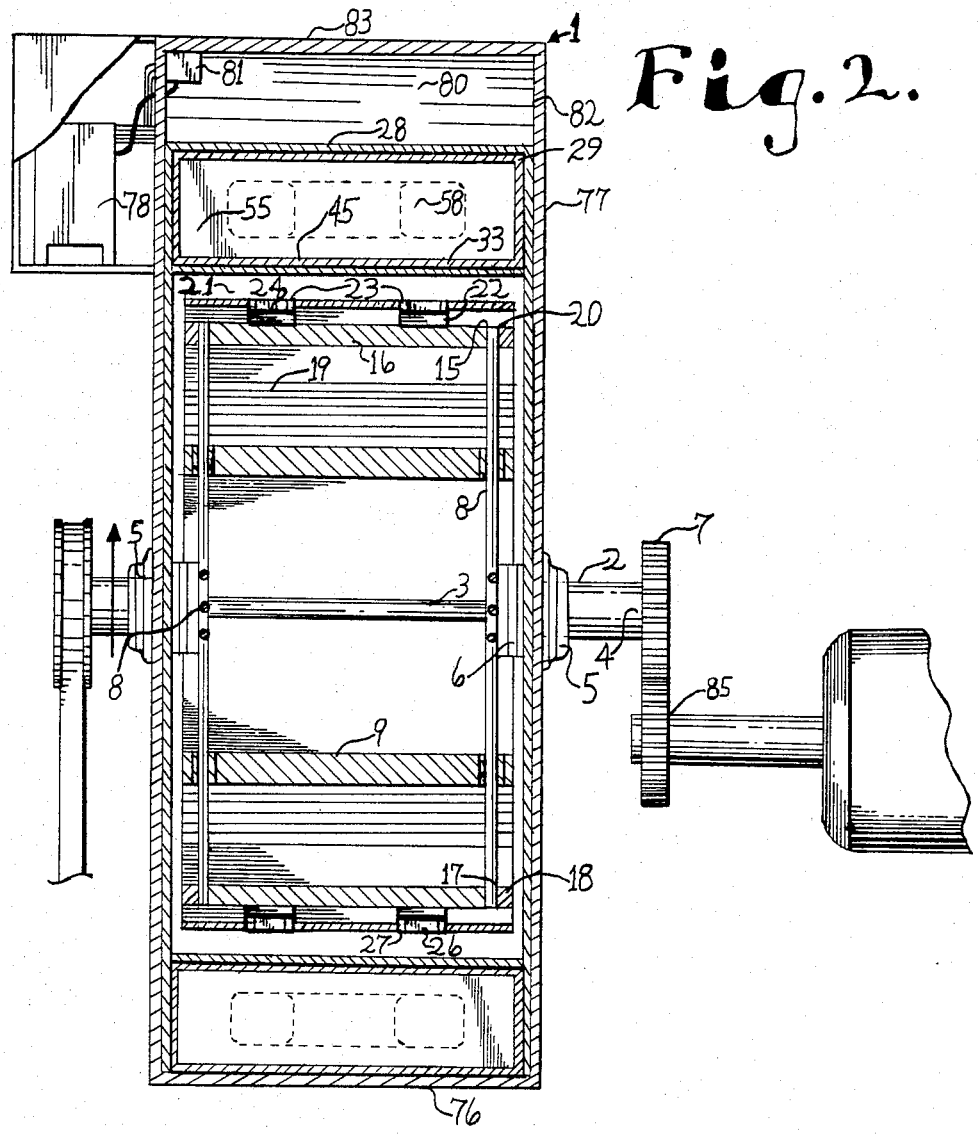
FIG. 2 is a cross-sectional view, with parts broken away, of the apparatus taken generally along line 2—2 in FIG. 1.

The compression-partial vacuum motor 29 is within an inner casing 28 and the outer casing 76. The compression-partial vacuum motor 29 is constructed in a curved manner to conform to the outer casing 76. The inner casing conforms to the outer casing 76 and is appended to a portion of the compression-partial vacuum motor 29 as shown in FIG. 2. The plurality of compression-partial vacuum motors 29 are appended to one another in a consecutive manner.

Figure 3:
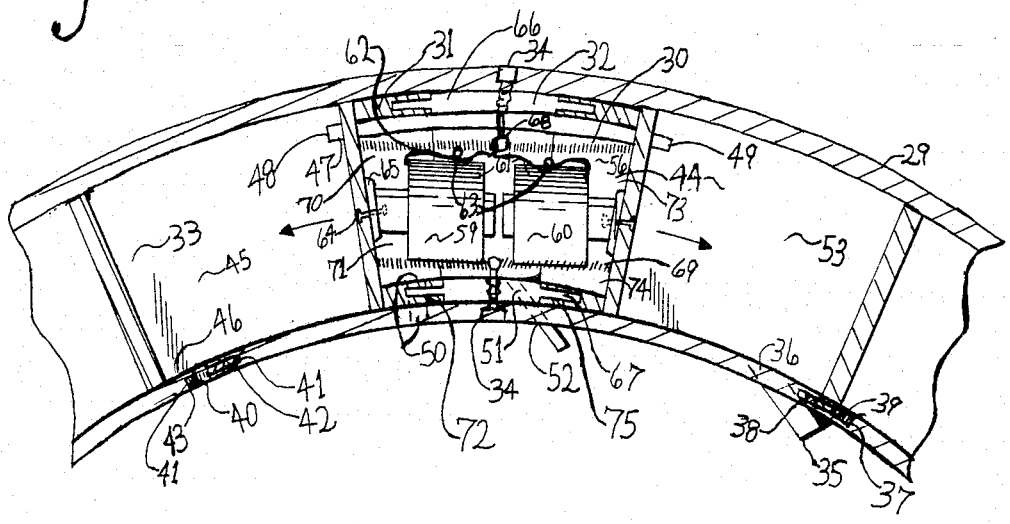
FIG. 3 is an enlarged fragmented cross-sectional view primarily of the compression-partial vacuum motor of the apparatus.

The compression-partial vacuum piston 30 has nonferrous side walls 31 with internal slots 72 and 75 which conform to the shape of the sides. An immobile wall section 66 is primarily centered in relation to the various lengths of the compression-partial vacuum piston 30. The immobile wall section 66 is attached to the correct casing 76, 28, and to the end outer casing 77 and has guides 67 within slots 72 and 75 in the nonferrous side walls 31 of the mobile heel arched nonferrous pan 71 and the mobile head arched nonferrous pan 74 to allow expansion and contraction as shown in FIG. 3. The internal slots 72 and 75 in the mobile heel nonferrous pan 71 and in the mobile head nonferrous pan 74 for the induction of the immobile wall section of the compression-partial vacuum piston 74 to allow proper guidance during expansion and compression of compressive-partial vacuum piston. The central portion of the compression-partial vacuum piston 32 is also the center of the immobile wall section 66 and is attached, as by bolts 34, to the contiguous casings.

Within the interior of the compression-partial vacuum piston 30 and attached to the immobile wall section 66 is attached an extended ring 68. As shown in FIG. 2, there is a compression spring 69 attached to each extended ring 68 for each planar portion 57 of the compression-partial vacuum piston 30; thus, allowing a more correct angle of force of the compression springs 69 to help with contraction during the intermittent operation.

The multipurpose electromagnets 59 and 60 of each pair are energized by a supply of electric current, to its coil 61. One of the multipurpose electromagnets 60 is intermittently energized and one of the multipurpose electromagnets 59 is continuously activated by a source of alternating electrical current (not shown). Each set of multipurpose electromagnets 58 are arranged with their axis linear and in linear alignment of the multipurpose electromagnets 59 and 60 being fixed to the farthest planar portion of the pans 57, as by rivets 64. The electromagnet coil 61 of the multipurpose electromagnets 59 is so wound that the confronting poles of the multipurpose electromagnet 60 are of like polarity, that is, both north poles or both south poles. Thus, when current is supplied to the intermittently activated multipurpose electromagnets 60, they repel each other, and hence supply a force tending to extend in opposite directions the compression-partial vacuum piston 30. Thus, compressing the atmosphere within a compression-partial vacuum chamber 33 within each end of the compression-partial vacuum motor 29. Thus, being efficient in employing the compressive energy of the apparatus 1.

Displacement of atmosphere by the compression-partial vacuum piston 30 partially results from the size of a compression-partial vacuum piston's planar surface 55.

Current is supplied by an electric cable 62, and the necessary leads to the multipurpose electromagnets 59 and 60 are contained in the electric cable 62 which enters body member in its immobile wall section 66 of the compression-partial vacuum piston 30. Cable leads are provided with sufficient slack, as indicated at 63, to permit extension of the compression-partial vacuum piston 30.

In use, the compression-partial vacuum piston 30 is supported within the central portion of the compression-partial vacuum motor 29, and the outermost face of the compression-partial vacuum piston 30 is positioned to influence the atmosphere in opposite atmospheric chambers 33. The purpose of dual atmospheric chambers 33 is to take advantage of Newton's law of opposite and equal reactions. Thus, employing both the equal and opposite force resulting from the intermittent expansion functioning of compression-partial vacuum piston 30. Therefore, representing an extremely efficient manner to perform appropriately.

The magnetic shield magnets 24 and turbine magnets 22 slightly distort this law in relation to the compression-partial vacuum piston 30, as while the turbine magnets 22 are being attracted by multipurpose electromagnets 59 and 60. While that is happening the multipurpose electromagnets 59 and 60 are toward a hindmost portion 46 of the heel atmospheric chamber 45 than they otherwise would be.

A conveyance tube 47 connects the head atmospheric chamber 53 and the heel atmospheric chamber 45 of one compression-partial vacuum motor 29. The conveyance tube 47 has an inlet 48 from the heel atmospheric chamber 45 and an outlet 49 to the head atmospheric chamber 53. The heel atmospheric chamber 45 and head atmospheric chamber 53 cooperate to force atmosphere through the atmospheric discharge jet 35 which directs a compressed jet of atmosphere to influence rotary motion and draft in the correct manner.

There is an inlet into the interior piston 50 from the turbine duct 21 to help cool electromagnets. The inlet is through the inner casing 28 and through the guide portion of immobile wall section 67 and there is a smaller adjoining orifice in immobile section 51 and immobile section orifice nozzle 52 which impinges heated atmosphere upon the turbine curved blades 19 which is supplementary to the other forces of the apparatus 1.

As shown in FIG. 1, a return orifice 40 is disposed at the hindmost portion 46 of each heel atmospheric chamber 45 to allow the entrance of atmosphere to result in localized partial vacuums to influence the turbine 20 and draft in the correct manner and to ready the compression-partial vacuum motor 29 for a compression stroke to force atmosphere through atmospheric discharge jets 35 located at the forefront of the head atmospheric chamber 54.

Within a plurality of return orifice slots 41 in the non-ferrous side wall 31 are a plurality of a return orifice permanent magnetic valve 42 magnetized in the heel atmospheric chamber 45 in relation to the hindmost portion in relation to the progress of the turbine 20 movement. In a related position in the head atmospheric chamber 53 is a jet magnetic slot 37 in the nonferrous side wall 31 for jet orifice permanent magnet valves 38 to open and close the valve to the atmospheric discharge jets 35 intermittently.

Upon the approach of the magnetic compression-partial vacuum piston 30, the movable permanent magnet valves 38 and 42 are repelled further outwardly from the compression-partial vacuum piston; thus, intermittently opening a head atmospheric chamber discharge jet orifice 36 and intermittently opening the return orifice 40. This arrangement allows the functioning of the valves 38 and 42 regardless of the positioning of the apparatus 1. A return orifice permanent magnet valve return springs 43 and a jet orifice permanent magnet valve return spring 39 return the return orifice permanent magnetic valve 42 and the jet orifice permanent magnet valve 38, respectively, into positions in relation to nonexpansion of the compression-partial vacuum piston 30.

Upon the contraction of the compression-partial vacuum piston 30, the jet orifice permanent magnet valve 38 and return orifice permanent magnet valve 42 contract; thus, the former valve 38 covers the jet orifice 36 and the latter valve 42 opens the return orifice 40. (An alternating embodiment is to employ a different type of valve, as pressure valves which would open in the desired manner to reduce pressure.)

Upon discontinuation of electrical current to one of the multipurpose electromagnets 59 of each set 58, the compression-partial vacuum piston 30 is compressed by the pressure of the remaining atmosphere. Moreover, compression springs 69 urge contraction of the mobile heel arched nonferrous pan 71 and the mobile head arched nonferrous pan 74 of the compression-partial vacuum piston 30 intermittently upon the discontinuation of the electric current to one of the set of two multipurpose electromagnet 60. This action creates a degree of suction and allows more atmosphere more rapidly from the return orifice 40; thus, readying the compression-partial vacuum piston 30 to again be expanded.

The efficiency can be adjusted by the multipurpose electromagnetic coils 61 employed as well as the size of compression-partial vacuum piston 30 and number of raps of the multipurpose electromagnets 59 and 60 and other similar factors.

The compression-partial vacuum motor 29 can be designed through conventional knowledge of whether to perform in relation to a greater distance or a shorter distance with greater force.

In operation, a compression and heat-induced draft through the multifunctional magnetic systems, draft, centrifugal force turbine 1 assists in overcoming magnetic interference. Furthermore, during motion of the turbine 20, the centrifugal forces developed thereby tend to overcome any adverse effects of magnetism.

Thus, the two major magnetic systems of the apparatus 1 are attraction and repulsion of the turbine magnets 22 by the multipurpose electromagnets 59 and 60. The multipurpose electromagnets 59 and 60 are positioned so as to intermittently attract and intermittently repulse the turbine magnets 22 which are constantly activated. The constantly activated turbine magnets 22 are intermittently influenced by the multipurpose electromagnets 59 and 60 while moving into the direct line of influence.

As shown in FIG. 2, U-shaped multipurpose electromagnets 59 and 60 each influence two turbine magnets 22 on a respective crosspiece 16. The multipurpose electromagnets 59 and 60 also repulse the poles of turbine magnets 22 of the same magnetism when positioned adjacent in a passed position.

The multipurpose electromagnets 59 and 60 in a row in the apparatus 1 have the same angulation with respect to the inner casing 28 and to the turbine magnet 22 at respective predetermined positions on the course of the turbine magnets. The multipurpose electromagnets 59 and 60 are secured by respective appendage components 65.

Magnetism is diminished by increased temperature. Thus, greater magnetic permeability within the multifunctional magnetic systems, draft, centrifugal force turbine 1 is accomplished by maintaining a lower temperature therein.

In order to cool the interior of the apparatus 1, a cooling unit 78 is provided with a cooling unit coil 79. In operation, the cooling unit 78 helps create a draft within the apparatus 1 which tends to cool the multipurpose electromagnetic coils 61 and, furthermore, facilitates rotation of the turbine 20 by the draft atmospheric movement which increases the rate of revolutions of the turbine. The augmented internal atmospheric draft is assisted by the head atmospheric discharge jet 35, immobile section orifice nozzle 52, and turbine curved blades 19. The cooling unit 78 operates on, for example, the same source of alternating electric current as the multipurpose electromagnets 59 and 60.

A warm atmospheric inlet orifice 80 for internal atmospheric gas is shown in FIG. 1 near the top of the multifunctional magnetic systems, draft, centrifugal turbine 1 and provides an entrance to a cooling unit channel 82. The cooling unit channel 82 extends from the warm atmospheric inlet orifice 80 toward the bottom of the apparatus 1 as shown in FIG. 1 and terminates at a cooler atmospheric outlet orifice 84. The cooler atmospheric outlet orifice 84 is situated to allow cooler atmosphere to impinge against the turbine curved blades 19. The cooling unit channel 82 is situated in a position to influence draft in a cooperative manner with the movement of the turbine 20 while employing characteristics of warm and cool atmospheres. The cooling unit channel 82, including the outermost cooling unit channel casing 83, is situated in a position to influence draft in a cooperative manner with the movement of the turbine 20.

An uplifting draft on the turbine 20 is created as a result of a number of factors, including the cooling unit's operation, design of the turbine 20, heat from the multipurpose electromagnets 59 and 60, and magnetic compression-partial vacuum motors 29; (also, cooler magnets function better than hot ones.)

The cooling unit 78 is provided with a cooling unit thermostat 81 to activate it at a predetermined temperature. The cooling unit 78 and the cooling unit channel 82 are designed to cool the multifunctional magnetic systems, draft, centrifugal force turbine's internal atmosphere and components, especially the multipurpose electromagnetic coils 61 and to contribute to the draft which facilitates rotation of the turbine 20. It is anticipated that a converter may be employed in connection with the cooling unit 78.

The turbine magnets 22 may assume various shapes including rectangular and the turbine magnets may be electromagnets. As an additional variation, the shape of the multipurpose electromagnets 59 and 60 within the apparatus 1 can vary in a systematic manner and there can be various types of multipurpose electromagnets in different models, including E-shaped and bar shaped.

The apparatus 1 employs a storage battery (not shown), a coil (not shown), a generating means (not shown), a voltage regulating means (not shown), and other components (not shown) employed with a typical internal combustion engine. The apparatus 1 may have an additional external source of electricity, especially when the work load is very heavy and/or the apparatus 1 revolves excessively slowly.

In another variation, the turbine magnets 22 and the magnetic shield magnets 24 can be disposed within a plurality of small casings to lessen heat effect resulting from friction.

In yet another variation (not shown), a disc brake may be provided mounted to a stationary component of the apparatus 1. The disc of the disc brake rotates with the shaft 2 while the shaft is in unhampered motion and stops the rotation thereof while a selector of functions releases and activates the disc brake.

An alternative embodiment is to employ a direct source of alternating electrical current; thus, making a commutator unnecessary.

Another alternative embodiment is to employ supercooled multipurpose electromagnets 59 and 60 with the necessary alternations.

It is to be understood that while certain forms of the present invention have been illustrated and described herein, it is not to be limited to the specific forms or arrangement of parts described and shown.

The following listing of components, etc. is an aid in correlating terms in the claims to exemplary drawings, the terms and reference numerals are:

1 multifunctional magnetic systems, draft, centrifugal force turbine
2 shaft
3 central reduced portion of shaft
4 shaft end portions
5 bearing unit
6 washer
7 shaft cog
8 support
9 expansible-contractive cylindrical divider
10 sheath of expansible-contractive cylindrical divider
11 bowed attachment 12 bowed attachment to the outermost end of support
13 bowed attachment spring
14 foreward side to the direction of turbine's movement
15 far end of support
16 crosspiece
17 end of crosspiece
18 support connector
19 turbine curved blades
20 turbine
21 turbine duct
22 turbine magnet
23 magnetic shield
24 magnetic shield magnet
25 outer poles of magnetic shield magnet
26 inner poles of magnetic shield magnet
27 nonmagnetic material
28 inner casing
29 compression-partial vacuum motor
30 compression-partial vacuum piston
31 nonferrous side wall of compression-partial vacuum piston
32 central portion of compression-partial vacuum piston
33 compression-partial vacuum chamber
34 bolt
35 atmospheric discharge jet
36 head atmospheric chamber discharge jet orifice
37 jet magnetic slot
38 jet orifice permanent magnet valve
39 jet orifice permanent magnet valve return spring
40 return orifice
41 return orifice slot
42 return orifice permanent magnet valve
43 return orifice permanent magnet valve return spring
44 interior of compression-partial vacuum motor
45 heel atmospheric chamber of compression-partial vacuum motor
46 hindmost portion of heel chamber
47 conveyance tube
48 inlet of conveyance tube
49 outlet of conveyance tube
50 inlet into interior of compression-partial vacuum piston through inner casing and guide
51 orifice in the immobile section
52 immobile section orifice nozzle
53 head atmospheric chamber of compression-partial vacuum motor)
54 forefront of head atmospheric chamber
55 compression-partial vacuum piston's planar surface
56 interior of compression-partial vacuum piston
57 planar portion of interior of compression-partial vacuum piston
58 set of multipurpose electromagnet
59 constantly activated multipurpose electromagnet
60 intermittently activated multipurpose electromagnet
61 multipurpose electromagnetic coil
62 electric cable
63 slack electric cable
64 rivet
65 appendage component (securing multipurpose electromagnets)
66 immobile wall section
67 guide portion of immobile wall section
68 extended ring
69 compression spring
70 segment one
71 mobile heel arched nonferrous pan
72 internal slot of heel nonferrous pan
73 segment two
74 mobile head arched nonferrous pan
75 internal slot of head nonferrous pan
76 outer casing
77 end outer casing
78 cooling unit
79 cooling unit coil
80 warm atmospheric inlet orifice
81 cooling unit thermostat
82 cooling unit channel
83 outermost cooling unit channel casing
84 cooler atmospheric outlet orifice
85 extrinsic component

I claim:

1. An electromagnetic turbine system, which comprises:
(a) an inner casing;
(b) a turbine including turbine blades rotatably mounted in said inner casing;
(c) a turbine magnet mounted on said turbine;
(d) an outer casing at least partly surrounding said inner casing;
(e) air pump means mounted between said inner and outer casings and including:
(1) a pair of electromagnets positioned in opposed relation to each other; and
(2) a piston slidably positioned between said inner and outer casings and connected to at least one of said electromagnets;
(f) discharge and return orifices in said inner casing for communicating air from said air pump means to said turbine blades; and
(g) means for selectively energizing at least one of said electromagnets.

2. The apparatus according to claim 1, which includes:
(a) a cooling unit mounted on said outer casing and having:
(1) a cooling unit channel with a warm air inlet orifice and a cool air outlet orifice each communicating with said inner casing;
(2) cooling unit located within said cooling unit channel; and
(3) refrigeration means for passing a fluid through said cooling unit coils at a temperature lower than the ambient air temperature within said system; and
(b) said cooling unit being adapted to create a draft from said warm air inlet orifice, through said cooling unit coils and from said cool air outlet orifice into said inner casing whereby said draft encounters said turbine blades and facilitates the rotation of said turbine.

3. The system according to claim 2, which includes:
(a) a thermostat located within said cooling unit channel for activating said cooling unit at a predetermined temperature.

4. The system according to claim 1, which includes:
(a) a plurality of said permanent turbine magnets mounted on a circumference of said turbine.

5. The system according to claim 4, which includes:
(a) a plurality of magnetic shields each comprising a nonmagnetic material and mounted on a respective permanent turbine magnet.

6. The system according to claim 5, which includes:
(a) a plurality of permanent magnetic shield magnets each mounted on a respective magnetic shield and angularly disposed with respect to a tangent to a path of revolution of said magnetic shield magnets.

7. The system according to claim 6 wherein:

(a) said turbine magnets are aligned with a tangent to a path of rotation thereof;

(b) each said magnetic shield magnet being angled with respect to an associated turbine magnet at an angle of 45 degrees or less, a leading edge of said magnetic shield magnet being located further from the turbine rotational axis than a trailing edge thereof.

8. The system according to claim 1, which includes:

(a) a plurality of said air pump means mounted in radially spaced relation between said inner and outer casings.

9. The system according to claim 1 wherein:

(a) said piston includes a pair of piston segments each attached to a respective electromagnet and slidably disposed between said inner and outer casings.

10. The system according to claim 9, which includes:

(a) a return chamber between said inner and outer casings and adjacent to one of said segments, said return chamber being selectively open at said return orifice; and (b) a discharge chamber between said inner and outer casings adjacent to said other segment, said discharge chamber being selectively open at said discharge orifice.

11. The system according to claim 9, which includes:

(a) said segments being interconnected by return springs adapted for biasing said segments toward each other when said electromagnets are deenergized.

12. The system according to claim 9, which includes:

(a) an air conveyance tube extending through said segments and communicating said return and discharge chambers.

13. The system according to claim 1, which includes:

(a) a magnetic inlet valve selectively closing said inlet orifice; and (b) a magnetic return valve selectively closing said return orifice.

14. The system according to claim 13, which includes:

(a) said return and discharge valves each having a respective magnet member.

15. The system according to claim 14, wherein:

(a) said magnet members are slidably received in respective return and discharge valve slots in said inner casing, said slots communicating with return and discharge orifices respectively.

16. The system according to claim 1, which includes:

(a) an air discharge jet communicating with said discharge orifice and angled in a direction of rotation of said turbine.

17. The system according to claim 1, which includes:

(a) a cylindrical divider coaxially mounted on said turbine and adapted to expand radially outwardly by centrifugal force associated with the rotation of said turbine.

18. The system according to claim 17, which includes:

(a) attachment means for said cylindrical divider including a spring adapted to facilitate the expansion and contraction thereof.

19. An electromagnetic turbine system, which comprises:

(a) an inner casing;

(b) a turbine rotatably mounted in said inner casing and including:

(1) a shaft coaxial with an axis of rotation of said turbine;

(2) a cylindrical divider connected to said shaft and adapted to expand radially outwardly by centrifugal force associated with the rotation of said turbine;

(3) a plurality of turbine blades mounted on said rotor and angled with respect to a direction of rotation of said turbine;

(4) a plurality of permanent turbine magnets mounted in radially spaced relation on said turbine in proximity to said blades;

(5) a plurality of nonmagnetic magnet shields each mounted on a respective turbine magnet; and (6) a plurality of magnetic shield magnets each mounted on a respective magnet shield;

(c) an outer casing at least partly surrounding said inner casing in radially-outwardly spaced relation therefrom;

(d) a plurality of air pump means positioned in radially spaced relation between said inner and outer casings, each said air pump means including:

(1) a piston including a pair of piston segments slidably disposed between said inner and outer casings;

(2) return and discharge chambers enclosed between said inner and outer casings and each being associated with a respective piston segment;

(3) a pair of electromagnets each mounted on a respective piston segment in opposed relation;

(f) a plurality of discharge valves each associated with a respective discharge chamber and including a discharge orifice through said inner casing and a discharge magnet member adapted for selectively closing said discharge orifice;

(g) a plurality of return valves each associated with a respective return chamber and including a return orifice and a return valve magnet adapted for selectively closing return orifice;

(h) a cooling unit mounted on said outer casing and including:

(1) a cooling unit channel with a warm air inlet orifice and a cool air outlet orifice each communicating with said inner casing;

(2) cooling coils located within said cooling unit channels; and (3) refrigeration means for passing a fluid through said cooling unit coils at a temperature lower than the ambient air temperature within said system; and (i) means for selectively energizing said electromagnets.

* * * * *